US011214958B1

(12) United States Patent
Lambach

(10) Patent No.: US 11,214,958 B1
(45) Date of Patent: Jan. 4, 2022

(54) FOAM WALL STRUCTURES AND METHODS FOR THEIR MANUFACTURE

(71) Applicant: Covestro LLC, Pittsburgh, PA (US)

(72) Inventor: James L. Lambach, McMurray, PA (US)

(73) Assignee: Covestro LLC, Pittsburgh, PA (US)

( * ) Notice: Subject to any disclaimer, the term of this patent is extended or adjusted under 35 U.S.C. 154(b) by 0 days.

(21) Appl. No.: 16/944,269

(22) Filed: Jul. 31, 2020

(51) Int. Cl.
*E04C 1/00* (2006.01)
*E04B 1/76* (2006.01)

(52) U.S. Cl.
CPC ..... *E04B 1/7654* (2013.01); *E04B 1/762* (2013.01)

(58) Field of Classification Search
None
See application file for complete search history.

(56) References Cited

U.S. PATENT DOCUMENTS

| | | | |
|---|---|---|---|
| 2,009,619 | A | 7/1935 | Huffine |
| 2,030,157 | A | 2/1936 | Cumpston |
| 2,055,032 | A | 9/1936 | Degian |
| 2,271,929 | A | 2/1942 | Venzie |
| 2,745,779 | A | 5/1956 | Ritter |
| 2,780,090 | A | 2/1957 | Rasmussen |
| 3,619,437 | A | 11/1971 | McDonald, Jr. |
| 3,785,913 | A | 1/1974 | Hallamore |
| 4,236,361 | A | 12/1980 | Boden |
| 4,292,775 | A | 10/1981 | Howard |
| 4,443,988 | A | 4/1984 | Coutu, Sr. |
| 4,471,591 | A | 9/1984 | Jamison |
| 4,671,038 | A | 6/1987 | Porter |
| 4,765,105 | A | 8/1988 | Tissington et al. |
| 4,786,547 | A | 11/1988 | St-Michel |
| 4,856,244 | A | 8/1989 | Clapp |
| 4,885,886 | A | 12/1989 | Rosso |
| 5,353,560 | A | 10/1994 | Heydon |
| 5,389,167 | A | 2/1995 | Sperber |
| 5,417,023 | A | 5/1995 | Mandish |
| 5,950,386 | A | 9/1999 | Shipman et al. |
| 5,950,389 | A | 9/1999 | Porter |
| 5,953,883 | A | 9/1999 | Ojala |
| 5,979,131 | A | 11/1999 | Remmele et al. |
| 6,085,479 | A | 7/2000 | Carver |

(Continued)

FOREIGN PATENT DOCUMENTS

| | | | |
|---|---|---|---|
| DE | 202014004695 | U1 | 7/2014 |
| IE | 20050080 | A1 | 8/2006 |

(Continued)

OTHER PUBLICATIONS

Oertel, Guenther, Polyurethane Handbook (2nd Edition), 1994, p. 276.

*Primary Examiner* — Basil S Katcheves
(74) *Attorney, Agent, or Firm* — Donald R. Palladino

(57) ABSTRACT

Foam wall structures and methods for making foam wall structures. The wall structures include a frame, a foam panel overlying a front surface of the frame, a first foam layer disposed in a cavity defined by the frame and the foam panel, in which the first foam layer self-adheres to one or more members of the frame, and a second foam layer disposed in the cavity. The second foam layer self-adheres to the first foam layer and has a density that is less than the density of the first foam layer.

13 Claims, 5 Drawing Sheets

(56) References Cited

U.S. PATENT DOCUMENTS

| | | | | |
|---|---|---|---|---|
| 6,205,729 | B1 | 3/2001 | Porter | |
| 6,308,491 | B1 | 10/2001 | Porter | |
| 6,314,695 | B1 | 11/2001 | Belleau | |
| 6,332,304 | B1 | 12/2001 | Fuhrman | |
| 6,408,594 | B1 | 6/2002 | Porter | |
| 6,438,915 | B1 | 8/2002 | Beauboeuf | |
| 6,481,172 | B1 | 11/2002 | Porter | |
| 6,715,249 | B2 | 4/2004 | Rusek | |
| 6,854,218 | B2 | 2/2005 | Weiss | |
| 7,036,284 | B1 | 5/2006 | Larson | |
| 7,127,858 | B2 | 10/2006 | Layfield | |
| 7,168,216 | B2 | 1/2007 | Hagen, Jr. | |
| 8,033,065 | B2 | 10/2011 | Paetkau et al. | |
| 8,065,846 | B2 | 11/2011 | McDonald et al. | |
| 8,365,497 | B2 * | 2/2013 | Rothwell | E04C 2/386 52/742.12 |
| 8,397,465 | B2 | 3/2013 | Hansbro et al. | |
| 8,458,983 | B2 | 6/2013 | Propst | |
| 8,635,778 | B1 | 1/2014 | Hagaman | |
| 8,844,243 | B1 | 9/2014 | Gillman | |
| 8,875,472 | B2 | 11/2014 | Korwin-Edson | |
| 8,925,270 | B2 * | 1/2015 | Grisolia | E04C 2/386 52/309.7 |
| 8,959,862 | B1 | 2/2015 | Kreizinger | |
| 9,145,688 | B2 | 9/2015 | Hunt-Hansen | |
| 9,523,195 | B2 | 12/2016 | Nandi | |
| 9,562,359 | B1 | 2/2017 | Grisolia et al. | |
| 9,938,711 | B2 | 4/2018 | Grisolia et al. | |
| 10,006,198 | B2 | 6/2018 | Parsons et al. | |
| 10,167,630 | B2 | 1/2019 | Giles | |
| 10,294,668 | B2 | 5/2019 | Kreizinger | |
| 10,301,823 | B2 | 5/2019 | Kreizinger | |
| 10,370,849 | B2 | 8/2019 | Lambach et al. | |
| 10,415,244 | B2 | 9/2019 | Giles et al. | |
| 2002/0012785 | A1 | 1/2002 | Leduc | |
| 2002/0108320 | A1 | 8/2002 | Weiss | |
| 2002/0129577 | A1 | 9/2002 | Weiss | |
| 2003/0041544 | A1 | 3/2003 | Devalapura | |
| 2004/0016194 | A1 | 1/2004 | Stefanutti et al. | |
| 2004/0200171 | A1 | 10/2004 | Schilger | |
| 2005/0055973 | A1 | 3/2005 | Hagen, III et al. | |
| 2005/0106360 | A1 | 5/2005 | Castiglione | |
| 2005/0188649 | A1 | 9/2005 | Hagen, III | |
| 2005/0247021 | A1 | 11/2005 | Schauffele | |
| 2006/0026925 | A1 | 2/2006 | Layfield | |
| 2007/0094963 | A1 | 5/2007 | McDonald et al. | |
| 2009/0098357 | A1 | 4/2009 | Bergtold | |
| 2009/0320397 | A1 | 12/2009 | Hansbro et al. | |
| 2010/0011701 | A1 | 1/2010 | Cole et al. | |
| 2010/0043327 | A1 | 2/2010 | Rothwell | |
| 2010/0095613 | A1 | 4/2010 | Paetkau | |
| 2011/0138724 | A1 * | 6/2011 | Olang | E04B 1/7604 52/309.4 |
| 2011/0173911 | A1 | 7/2011 | Propst | |
| 2011/0214374 | A1 | 9/2011 | Propst | |
| 2012/0011792 | A1 | 1/2012 | Dewildt et al. | |
| 2012/0028563 | A1 | 2/2012 | Sacks | |
| 2012/0096785 | A1 | 4/2012 | Weeks | |
| 2012/0159765 | A1 | 6/2012 | Propst | |
| 2012/0240501 | A1 | 9/2012 | Spiegel | |
| 2012/0247040 | A1 | 10/2012 | Buoni et al. | |
| 2013/0104469 | A1 | 5/2013 | Fay | |
| 2013/0104480 | A1 | 5/2013 | Smith | |
| 2013/0305643 | A1 | 11/2013 | Singleton et al. | |
| 2013/0312350 | A1 | 11/2013 | Kreizinger | |
| 2014/0053486 | A1 | 2/2014 | Grisolia et al. | |
| 2014/0115991 | A1 * | 5/2014 | Sievers | E04B 1/665 52/309.4 |
| 2014/0250827 | A1 | 9/2014 | Gillman | |
| 2014/0265027 | A1 | 9/2014 | Kreizinger | |
| 2015/0093535 | A1 | 4/2015 | Lambach et al. | |
| 2015/0111001 | A1 | 4/2015 | Sagnard et al. | |
| 2015/0140243 | A1 | 5/2015 | Sagnard et al. | |
| 2017/0030074 | A1 | 2/2017 | Ndobo-Epoy et al. | |
| 2017/0044759 | A1 * | 2/2017 | Kreizinger | B32B 5/20 |
| 2018/0112394 | A1 * | 4/2018 | Giles | E04B 1/7629 |
| 2018/0202159 | A1 * | 7/2018 | Kreizinger | E04B 2/707 |
| 2019/0100917 | A1 | 4/2019 | Malinowski | |
| 2019/0242127 | A1 * | 8/2019 | Kreizinger | E04B 2/707 |
| 2020/0141118 | A1 * | 5/2020 | Kreizinger | B32B 27/40 |

FOREIGN PATENT DOCUMENTS

| | | | |
|---|---|---|---|
| JP | 5546961 | A | 4/1980 |
| JP | 56000437 | A | 1/1981 |
| JP | 60108609 | U | 7/1985 |
| JP | 3115643 | A | 5/1991 |
| JP | 11200521 | A | 7/1999 |
| JP | 2008132676 | A | 6/2008 |
| JP | 3159655 | U | 5/2010 |
| JP | 2013091246 | A | 5/2013 |
| WO | 9914442 | A1 | 3/1999 |
| WO | 9929978 | A1 | 6/1999 |
| WO | 2020120382 | A1 | 6/2020 |

* cited by examiner

FOAM WALL STRUCTURES AND METHODS FOR THEIR MANUFACTURE

FIELD

The inventions described in this specification relate to foam wall structures that include foam layers of different densities, as well as to methods for their manufacture.

BACKGROUND

Relatively recently, insulated wall structures satisfying strict industry insulation requirements have been developed that can be made without excessive material and labor costs. According to one proposal, a foam wall structure includes a foam panel, such as a faced polyisocyanurate panel, attached to at least a portion of a front frame surface, such that the faced polyisocyanurate panel and frame members define one or more voids within the frame; and a foam layer received within at least a portion of one of the voids within the frame, wherein the foam layer adheres to at least a portion of the faced polyisocyanurate panel.

Such foam wall structures can provide many benefits. They can exhibit high racking shear strength and excellent thermal resistance. Moreover, they can be fabricated in a controlled, possibly highly automated, manufacturing facility that is away from the construction site, thus increasing the likelihood of consistent results/performance, all while reducing labor and material costs.

While such foam wall structures can provide many benefits, it would be desirable to provide foam wall structures that satisfy the strict industry insulation requirements, that have sufficient structural strength, and that can be made without excessive labor costs, all while reducing material costs.

The inventions described in this specification were made in view of the foregoing.

SUMMARY

In certain respects, the specification relates to wall structures. These wall structures comprise: (a) a frame comprising: (i) a first member; (ii) a second member spaced apart from the first member; and (iii) connecting members extending between the first member and the second member, wherein the first member, the second member, and the connecting members each comprise a front surface and a rear surface that form a front frame surface and a rear frame surface; (b) a foam panel overlying the front frame surface, wherein the foam panel, the first member, the second member, and the connecting members define a cavity; and (c) a first foam layer having a density of at least 2.8 lb/ft$^3$ disposed within the cavity, the first foam layer being self-adhered to the foam panel and self-adhered to at least one of the first member, the second member, and one or more connecting members, and (d) a second foam layer having a density of less than 2.8 lb/ft$^3$ that is disposed within the cavity and self-adhered to the foam panel and self-adhered to the first foam layer.

In other respects, this specification relates to methods for manufacturing wall structures. The methods comprise: (a) spray depositing a first foam-forming material into a cavity defined by a frame and a foam panel overlying a front frame surface, wherein the front frame surface is formed by a front surface of a first member, a front surface of a second member that is spaced apart from the first member, and a front surface of connecting members extending between the first member and the second member; (b) allowing the first foam-forming material to cure to form a first foam layer in the cavity, the first foam layer being adhered to the foam panel and at least one of the first member, the second member, and a connecting member; (c) spray depositing a second foam-forming material into the cavity; and (d) allowing the second foam-forming material to cure to form a second foam layer in the cavity, the second foam forming layer being adhered to the first foam layer and having a density that is less than the density of the first foam layer.

The present specification also relates, among other things, to buildings comprising such wall structures.

BRIEF DESCRIPTION OF THE DRAWINGS

Various features and characteristics of the inventions described in this specification may be better understood by reference to the accompanying figures, in which.

Figure 1:
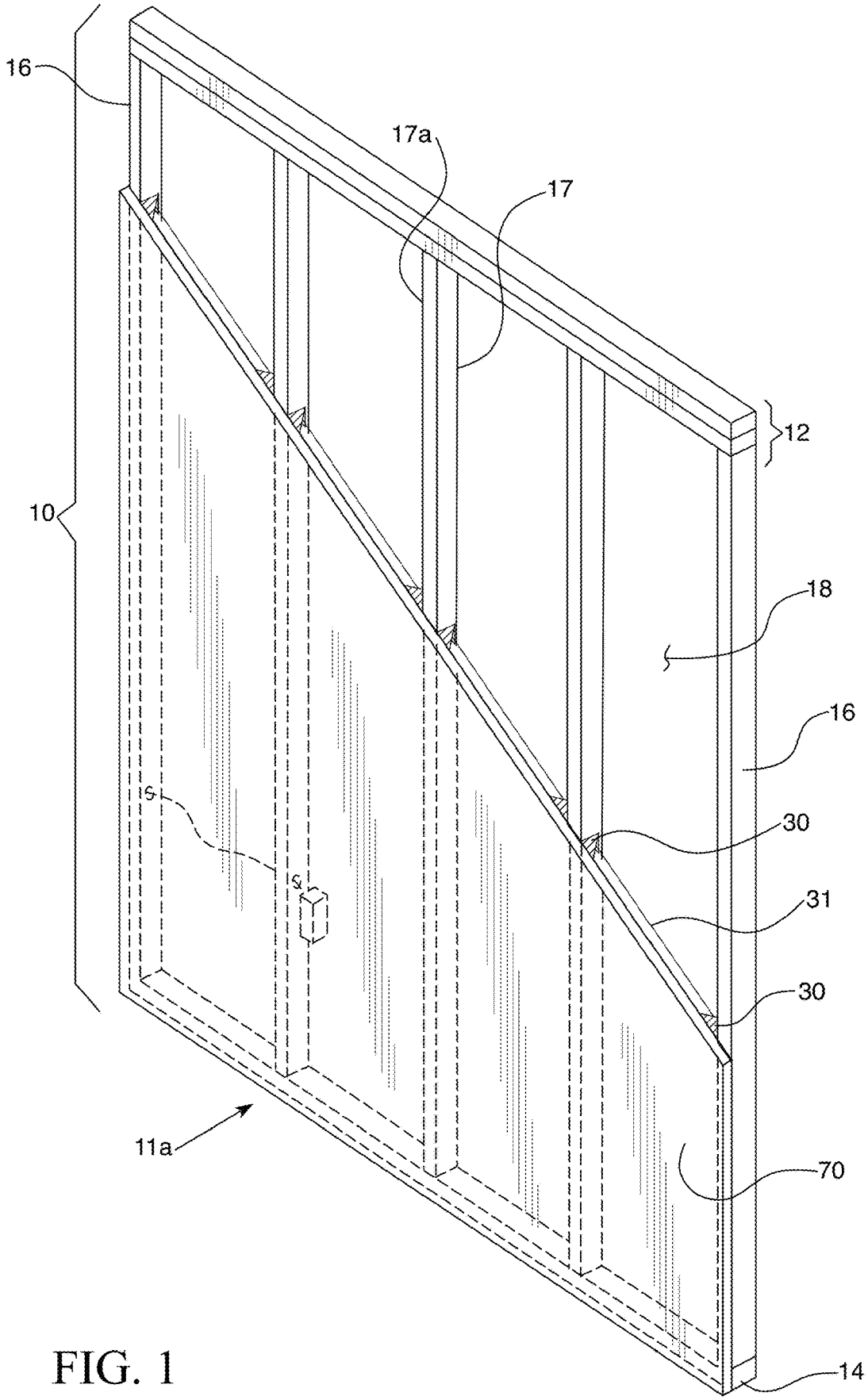
FIG. 1 is a front perspective view of an embodiment of a wall structure of this specification.
Figure 2:
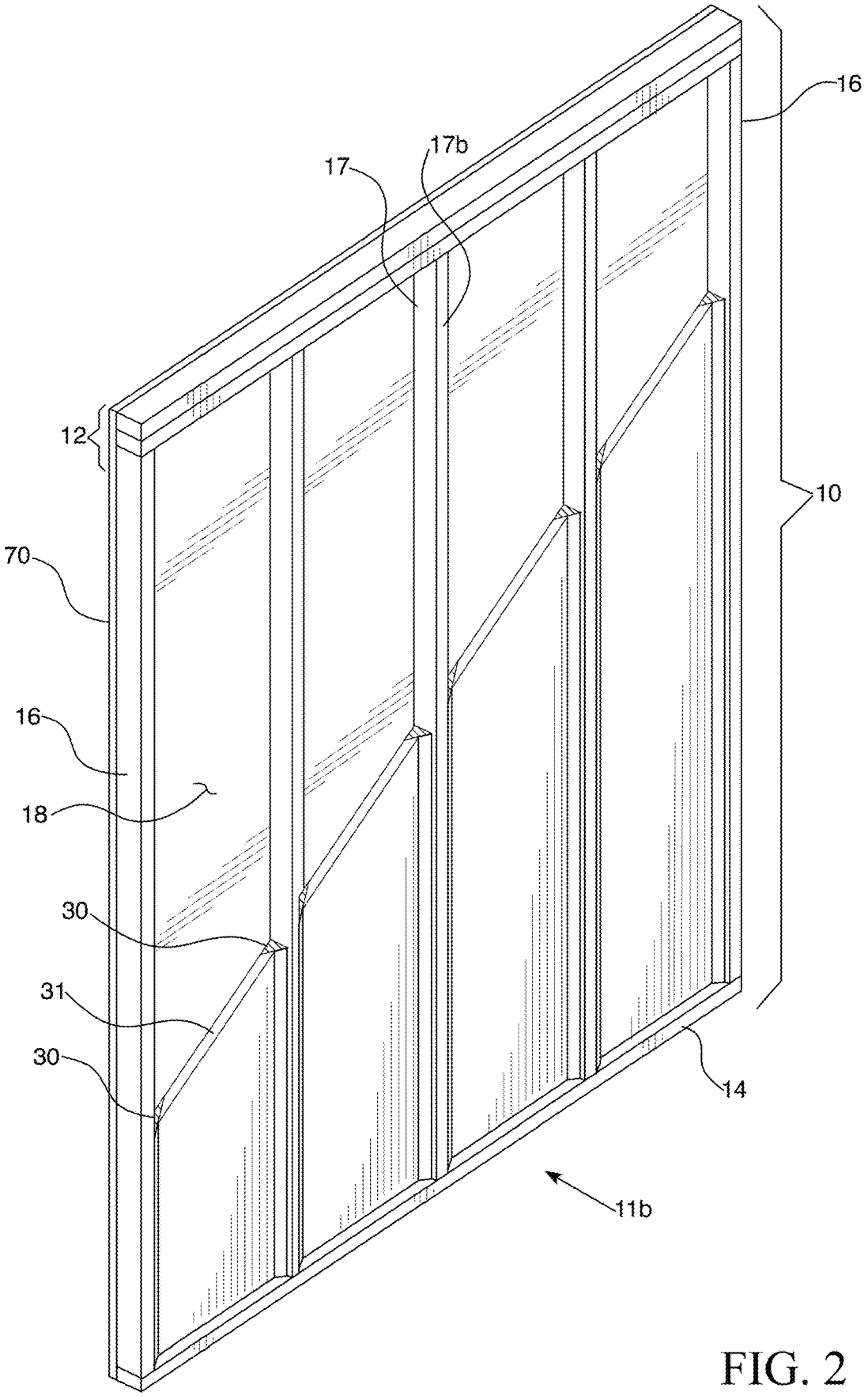
FIG. 2 is a rear perspective view of the foam wall structure of FIG. 1.
Figure 3:
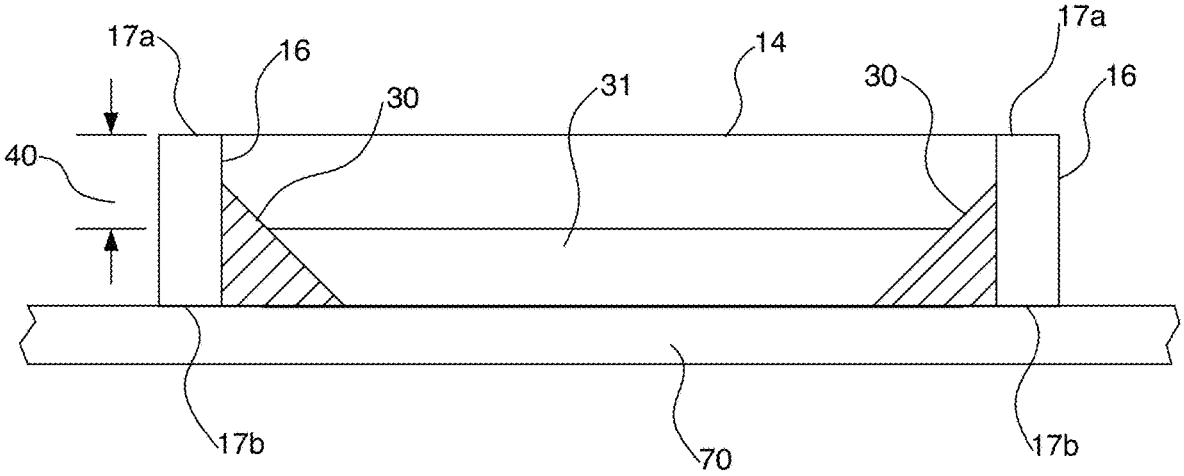
FIG. 3 is a top cross-sectional view of the foam wall structure of FIG. 1.

The reader will appreciate the foregoing features and characteristics, as well as others, upon considering the following detailed description of the inventions according to this specification.

DETAILED DESCRIPTION

As used in this specification, the term "front" refers to the side, face, or surface of a structure or component oriented towards the outside direction of an exterior wall of a building, and the term "rear" refers to the side, face, or surface of a structure or component oriented towards the inside direction of an exterior wall of a building.

The present specification is directed to wall structures, methods for their manufacture, and use of such structures as a wall in a building. Referring to the Figures, a wall structure 10 comprises frame 11. The frame 11 comprises a first member 12, a second member 14 spaced apart from the first member 12, and connecting members (such as the two side members and primary support member) 16, 17 extending between the first member 12 and the second member 14. As used herein, the term "connecting member" refers to a member that connects first member 12 with second member 14 and includes side members 16 and primary support members 17. The first member 12, the second member 14, and the connecting members 16, 17 each comprise a front surface and a rear surface that collectively form a front frame surface 11*a* and a rear frame surface 11*b*. The constituent members (12, 14, 16, and 17) of the frame 11 can be made out of a suitable material of construction such as wood. For example, the constituent members (12, 14, 16 and 17) of the frame 11 can comprise wooden 2×4 members (i.e., structural members made of wood having nominal thicknesses of about 2-inches, nominal widths of about 4-inches, and suitable lengths) secured together with fasteners such as nails, nail plates, screws, staples, bolts, or rivets, or a combination of any thereof.

According to the wall structures of this specification, a foam panel 70 overlies, and in some cases abuts, the front frame surface 11*a*. As used herein, "abut", when used with reference to the foam panel 70 "abutting" the front frame surface 11*a*, means that the foam panel 70 at least partially touches the front frame surface 11*a* so that at least some of portion of the foam panel 70 is not spaced apart from the front frame surface 11*a*. In other words, the foam panel 70 at least partially directly overlies the front frame surface 11*a* with no gap between them. As used herein, "overlie" means that a component is at least partially disposed towards the front of the wall structure relative to another component. Thus, foam panel 70 is at least partially disposed towards the front of wall structure 10 relative to front frame surface 11*a*.

As used in this specification, the term "foam panel" refers to panels comprising foam, such as, for example, polyisocyanurate (sometimes referred to as "polyiso") foam panels, expanded polystyrene foam panels, and extruded polystyrene foam panels. As will be appreciated, such foam panels have relatively low fastener pull-out strength as compared to wood panels, plywood panels, and OSBs. Accordingly, "foam panel" as used in this specification, is to be distinguished from wood panels, plywood panels, and OSBs, for example. As used herein, "foam" refers to a substance that is formed by trapping pockets of gas in a liquid or solid. In certain embodiments, the foams described in this specification are "closed-celled" foams. The term "closed-celled foam", as used in this specification, means that the foam has a closed cell content of at least 80%, sometimes at least 90%, when measured according to ASTM D6226-15, which is incorporated herein by reference. In certain embodiments, the foams described in this specification are "rigid" foams. The term "rigid foam" refers to a foam having a ratio of compressive strength to tensile strength of at least 0.5:1, elongation of less than 10%, and a low recovery rate from distortion and a low elastic limit, as described in "Polyurethanes: Chemistry and Technology, Part II Technology," J. H. Saunders & K. C. Frisch, Interscience Publishers, 1964, page 239, which is incorporated herein by reference. The term "panel", as used in this specification, refers to a solid, relatively thin and flat slab of material, which in some cases, has a rectangular or square shape. In some embodiments, the foam panels described herein have a thickness of no more than 2 inches (5.08 cm), such as a thickness of 1 to 2 inches (2.54 to 5.08 cm) or 1 to 1.5 inches (2.54 cm to 3.81 cm).

The foam panel 70 overlying the front frame surface 11*a* can comprise a facer on a rear face and/or a front face of a core foam layer. Thus, as will be appreciated, in these implementations, it is a facer on the rear face of the core foam layer of the foam panel 70 that abuts and overlies front frame surface 11*a*.

For example, the foam panel 70 may comprise a polyiso panel comprising a polyisocyanurate foam core layer and a facer attached to a front face and/or a rear face of the polyisocyanurate foam core layer. In certain implementations, the facer is attached to and substantially covers both sides (the front and rear faces) of a polyisocyanurate foam core layer or other foam core layer. For example, facers can comprise glass mats filled with recycled cardpanel and colored with carbon black. Facers can also comprise foil or foil/glass composites. Facers can also comprise fibrous materials such as fiberglass materials or other fiber-reinforced sheet-like materials. Examples of suitable facers include, but are not limited to, fiberglass mats, glass fiber-reinforced cellulosic felts, coated and polymer-bonded fiber mats (e.g., fibrous glass mats bonded with an organic polymer binder and coated with an organic polymer coating, clay, or other inorganic coating), foils (e.g., aluminum foil), coated foils, foil/membrane laminates, foil/glass composites, and polyolefin films (such as TYVEK® materials, available from DuPont; or TYPAR® materials, available from Fiberweb, Inc.). If a polyiso panel or other type of foam panel comprises a facer on both the front and rear faces of the polyisocyanurate foam layer or other core layer, then the facer on the front face may be the same as or may be different than the facer on the rear face. In some implementations, the facer acts as a water-resistant barrier. In some implementations, the facer meets the requirements as described in ASTM D226/D226M-09: Standard Specification for Asphalt-Saturated Organic Felt Used in Roofing and Waterproofing; or ASTM E2556/E2556M-10: Standard Specification for Vapor Permeable Flexible Sheet Water-Resistive Barriers Intended for Mechanical Attachment; or otherwise qualifies as a water-resistive barrier in accordance with International Residential Code (IRC) 703.2 (2012), which are each incorporated by reference into this specification. For embodiments in which the foam panel comprises a polyiso panel, the foam panel may meet the requirements of ASTM C1289-15: Standard Specification for Faced Rigid Cellular Polyisocyanurate Thermal Insulation Panel, which is incorporated by reference into this specification.

The foam panel 70 is often fastened to the front frame surface 11*a*. The foam panel 70 can be fastened to any of the front faces (12*a*, 14*a*, 16*a* and/or 17*a*) of the constituent members (12, 14, 16 and 17) of the frame 11. For example, the foam panel 70 can be attached to the front faces 12*a* and 14*a* of the first and second members 12 and 14 and to the front faces 16*a*, 17*a* of the connecting members 16, 17 extending therebetween. The foam panel 70 can be attached to the front frame surface 11*a* with fasteners and/or an adhesive (not shown). Mechanical fasteners can include, but are not limited to, nails, staples, screws, bolts, or rivets, or a combination of any thereof. Attachment adhesives can comprise a construction adhesive that is compatible with the adjoining materials. For example, an adhesive used to fasten a foam panel to a frame can comprise a foam material (which may be the same foam material or a different foam material as the foam material comprising the foam layers, described below).

The foam panel 70, the first member 12, the second member 14, and the connecting members 16, 17 define a cavity within the frame 11. A first foam layer 30 is located within the cavity. The first foam layer 30 is self-adhered to foam panel 70 and covers at least a portion of the rear surface of foam panel 70. As used herein, the term "self-adhered" means that a material adheres, i.e., bonds to, another material without the use of a separate adhesive or other material. In certain implementations, the first foam layer 30 does not extend out from and/or overlie the front frame surface 11*a*. In addition, in some implementations, such as shown in the Figures, first foam layer 30 does not cover the entire rear surface of foam panel 70. Rather, first foam layer 30 is disposed within the cavity such that it is self-adhered to at least one of the first member 12, the second member 14, and a connecting members 16,17. In some cases, again as illustrated in the Figures, first foam layer 30, while not covering the entire rear surface of foam panel 70, is disposed within the cavity such that it is self-adhered to each of the first member 12, the second member 14, and two connecting members 16,17, thus forming a "picture frame" of first foam layer 30 around the perimeter of cavity 18. In fact, it was a surprising discovery that disposing a relatively thin layer of first foam layer 30, which has a fairly high density (as described below) around the perimeter of cavity 18 can provide a wall structure 10 that has a shear strength that is nearly as great as if first foam layer 30 were disposed throughout the entire width of cavity 18. As a result, it is believed possible to utilize relatively high density first foam layer 30 in combination with a relatively low density (described below) second foam layer 31, to provide a foam wall structure that satisfies the strict industry insulation requirements, has sufficient structural strength, and can be made without excessive labor costs, all while reducing material costs.

The first foam layer 30 can comprise, for example, polyurethane, polyurea, or polyisocyanurate, or a mixture thereof. The first foam layer 30 can be substantially free, essentially free, or completely free of halogen-containing flame retardant additives.

Examples of foam materials include, but are not limited to, foams made with polyurethane, polyurea, polyisocyanurate (also referred to as polyiso), and mixtures thereof. Foam materials (including the first foam layer 30) may be substantially free, may be essentially free, or may be completely free of halogen-containing flame retardant additives. The term "halogen" refers to the halogen elements, which include fluorine, chlorine, bromine, and iodine, and the term "halogen-containing flame retardant additives" refers to a substance that may be used to inhibit or resist the spread of fire, and which contains halogen groups such as a fluoro, chloro, bromo, and/or iodo groups. Further, the term "substantially free," as used in this specification, means the foam material contains less than 1000 parts per million (ppm), "essentially free" means less than 100 ppm, and "completely free" means less than 20 parts per billion (ppb) of halogen-containing flame retardant additives.

As indicated earlier, first foam layer 30 has a fairly high density. More particularly, in certain embodiments, the density of the first foam layer 30 is at least 2.8 lb/ft$^3$ (44.9 kg/m$^3$), such as 2.8 to 4.0 lb/ft$^3$ (44.9 to 64.1 kg/m3), or, in some cases, 3.0 to 4.0 lb/ft$^3$ (48.1 to 64.1 kg/m$^3$) or 3.2 to 3.8 lb/ft$^3$ (51.3 to 60.9 kg/m$^3$) or 3.4 to 3.8 lb/ft$^3$ (54.5 to 60.9 kg/m$^3$), when measured according to ASTM D1622-08.

As illustrated in the Figures, in some embodiments, first foam layer 30 comprises a thickness extending from the rear surface of the foam panel 70 to a position intermediate the front frame surface 11*a* and the rear frame surface 11*b*. In this manner, a gap may be formed within the frame 11 between a rear surface of first foam layer 30 and the rear frame surface 11*b*. Although the Figures show first foam layer 30 comprising a thickness extending from the rear surface of the foam panel 70 to a position intermediate the front frame surface 11*a* and the rear frame surface 11*b*, it is understood that first foam layer 30 can alternatively comprise a thickness extending from the rear surface of the foam panel 70 to the rear frame surface 11*b*, in which case there may be no gap formed within the frame 11 between the rear surface of first foam layer 30 and the rear frame surface 11*b*. In some embodiments, first foam layer 30 has a maximum depth, measured from the rear surface of first foam layer 30 to the rear frame surface 11*b*, of no more than 3 inches (7.62 cm), such as at least 1.5 inches (3.81 cm), such as 1.5 to 3 inches (3.81 to 7.62 cm) or 1.5 to 2.5 inches (3.81 to 6.35 cm).

First foam layer 30 is formed in-situ during the manufacturing process of the wall structure 10 thereby enabling first foam layer 30 to be self-adhered to at least one of the first member 12, the second member 14, and a connecting member 16,17, The term "in-situ formed foam layer", as used in this specification, refers to a layer of foam that is formed during manufacturing of the wall structure 10, such as at a manufacturing location remote or away from a building construction site. As such, the foam layer 30 may be formed not at a construction site as is required by conventional methods, but instead as a component of the pre-fabricated foamed wall structure 10.

Moreover, as earlier described, first foam layer 30 may be disposed within cavity 18 such that it is self-adhered to at least one of the first member 12, the second member 14, and a connecting member 16,17, but does not cover the entire rear surface of foam panel 70. In these implementations, first foam layer 30 may have a maximum width, measured from an interior surface of first member 12, the second member 14, and a connecting members 16,17 to a rear surface of first foam layer 30, of, for example, no more than 6 inches (15.24 cm), such as 2 to 6 inches (5.08 to 15.24), or 3 to 5 inches (7.62 to 12.7 cm).

In the foam wall structures of this specification, a second foam layer 31 is disposed within cavity 18. In some implementations, such as is illustrated in the Figures, second foam layer 31 is also self-adhered to foam panel 70 and covers at least a portion of the rear surface of the foam panel 70. In certain implementations, second foam layer 31 does not extend out from and/or overlie the front frame surface 11*a*.

Second foam layer 31 is disposed within the cavity and is self-adhered to first foam layer 30. In addition, in some implementations, such as shown in the Figures, second foam layer 31 does not cover the entire rear surface of foam panel 70, but covers any portions of the rear surface of foam panel 70 that is not covered by first foam layer 30. Thus, in some implementations, second foam layer 31 forms the "picture" within the "picture frame" formed by first foam layer 30.

As with first foam layer 30, second foam layer 31 can comprise, for example, polyurethane, polyurea, or polyisocyanurate, or a mixture thereof. Second foam layer 31 can also be substantially free, essentially free, or completely free of halogen-containing flame retardant additives. In certain implementations, first foam layer 30 and second foam layer 31 both comprise polyurethane. However, in other implementations, first foam layer 30 and second foam layer 31 may comprise different chemistries.

Unlike first foam layer 30, however, second foam layer 31 has a fairly low density. More particularly, in certain embodiments, the density of second foam layer 31 is less than 2.8 lb/ft$^3$ (44.9 kg/m$^3$), such as 1.5 to 2.5 lb/ft$^3$ (24.0 to 40.0 kg/m$^3$), or, in some cases, 1.7 to 2.3 lb/ft$^3$ (27.2 to 36.8 kg/m$^3$) or 1.8 to 2.2 lb/ft$^3$ (28.8 to 35.2 kg/m$^3$), when measured according to ASTM D1622-08. In addition, in some implementations, second foam layer 31 has a density that is at least 0.5 lb/ft$^3$ (8.0 kg/m$^3$) less than the density of first foam layer 30. In some cases, second foam layer 31 has a density that is 0.5 to 2.0 lb/ft$^3$ (8.0 to 32.0 kg/m$^3$), 0.7 to 1.3 lb/ft$^3$ (11.2 to 20.8 kg/m$^3$) or 0.8 to 1.2 lb/ft$^3$ (12.8 to 19.2 kg/m$^3$) less than the density of first foam layer 30, each when measured according to ASTM D1622-08. As will be appreciated, various techniques may be used to produce a foam layer of lower density relative to another foam layer, such as by incorporating a higher percentage of blowing agent into the foam-forming composition.

As with first foam layer 30, second foam layer 31 is also an "in-situ formed foam layer", as defined above, thereby enabling second foam layer 31 to be self-adhered to first foam layer 30 and to foam panel 70.

As illustrated in the Figures, in some embodiments, second foam layer 31 comprises a thickness extending from the rear surface of the foam panel 70 to a position intermediate the front frame surface 11*a* and the rear frame surface 11*b*. In this manner, a gap 40 may be formed within the frame 11 between a rear surface of second foam layer 31 and the rear frame surface 11*b*. Although the Figures show second foam layer 31 comprising a thickness extending from the rear surface of the foam panel 70 to a position intermediate the front frame surface 11*a* and the rear frame surface 11*b*, it is understood that second foam layer 31 can alternatively comprise a thickness extending from the rear surface of the foam panel 70 to the rear frame surface 11*b*, in which case there may be no gap formed within the frame 11 between the rear surface of second foam layer 31 and the rear frame surface 11*b*. In some embodiments, gap 40 has a width, from the rear surface of second foam layer 31 to the rear frame surface 11*b*, of at least 1 inch (2.54 cm), such as 1 to 2 inches (2.54 to 5.08 cm) or 1.5 to 2 inches (3.81 to 5.08 cm).

This specification also relates to methods for manufacturing the foam wall structures described herein. These methods comprise spray depositing a first foam-forming material into a cavity defined by a frame and a foam panel overlying a front frame surface, wherein the front frame surface is formed by a front surface of a first member, a front surface of a second member that is spaced apart from the first member, and a front surface of connecting members extending between the first member and the second member.

For example, in some implementations, a frame 11 can be positioned substantially horizontally, such as where the frame 11 is positioned on a framing table where the frame 11 may be constructed. As used herein, the phrase "substantially horizontal" when used with reference to the position of the frame when the foam panel is attached means that the longest dimension of each of the frame members 12, 14, 16 and 17 is positioned generally horizontally, though modest deviations from true horizontal of up to 30°, in some cases up to 20° or up to 10° are also encompassed by the term "substantially horizontal".

The framing table may hold the frame members in the required position while the framing members are attached to each other, using suitable fasteners. A framing table can be highly suitable for ensuring that the frame members are attached to each other at the perpendicular and parallel positions to each other (if desired) and therefore can also ensure that foam panel 70 when attached to the frame 11 are also installed in the same plane. This means that the surfaces 12*a*, 14*a*, 16*a*, 17*a*, are in the same plane and flat and flush so that the gap between these surfaces and the foam panel 70 is minimized; making it easier to attach foam panel 70 in the desired position on the frame 11.

In certain implementations, after ensuring correct attachment of the framing members, the frame 11 may, if desired, be moved on to a tilting device, such as a tiltable platform. Such a tilting device receives the frame 11 in a substantially horizontal position and is capable of placing the frame 11 having foam panel 70 fastened thereto on a conveyor configured to convey the frame 11 having foam panel 70 fastened thereto in a substantially upright position. In some embodiments, frame 11 may rest on a tiltable platform that is oriented substantially horizontally while foam panel 70 is fastened to the front frame surface 11*a* of the frame 11.

A foam panel 70 can be oriented so as to overlay front frame surface 11*a* so that the foam panel 70, the first member 12, the second member 14, and the connecting members 16, 17 define a cavity 18. Foam panel 70 can be fastened to the front frame surface 11*a* of, for example, a substantially horizontally positioned frame. Foam panel 70 can be fastened to the front frame surface 11*a* while the frame 11 is positioned substantially horizontally, such as where the frame 11 is on a framing table where the frame 11 may be constructed.

In certain implementations, foam panel 70 is attached to the front frame surface 11*a* such that foam panel 70 abuts and overlies front frame surface 11*a* and is fastened to any of the front faces (12*a*, 14*a*, 16*a* and/or 17*a*) of the constituent members (12, 14, 16, and 17) of the frame 11. For example, foam panel 70 can be fastened to the front faces 12*a* and 14*a* of the first and second members 12 and 14 and/or to the front faces 16*a*, 17*a* of the connecting members 16, 17 extending therebetween. The foam panel 70 can be fastened to the front frame surface 11*a* with fasteners and/or an adhesive (not shown). Attachment fasteners can include, but are not limited to, nails, staples, screws, bolts, or rivets, or a combination of any thereof. Attachment adhesives can comprise a construction adhesive that is compatible with the adjoining materials. For example, an adhesive used to fasten a foam panel to a frame can comprise a foam material (which may be the same foam material or a different foam material as the foam material comprising the foam layers). Because foam panel 70 may comprise polyisocyanurate foam or foams having relatively low fastener pull-out strength, care should be used when mechanically fastening a foam panel 70 to frames so as not to damage the foam panels.

In certain implementations, foam panel 70 is attached to the front frame surface 11*a* by using fasteners, such as SCRAIL® collated nails (commercially available from FASCO America®, Muscle Shoals, Alabama) equipped with a continuous rigid insulation washer (a "CI washer"). Alternatively, foam panel 70 can be fastened to the front frame surface by the use of one or more adhesives selected from latex-based adhesives, reactive hot melts, polyester adhesives, polyamide adhesives, acrylic adhesives, one-component epoxy-based adhesives, one-component polyurethane-based adhesives, two-component polyurethane-based adhesives, and combinations of any thereof. Also, as described below, a foam material may be used as the adhesive. For example, a layer of foam may be applied to the foam panel 70, the front frame surface 11*a*, or both, before positioning and attaching the foam panel 70 to the front frame surface 11*a*.

The foam panel 70 fastened to the frame 11 may comprise multiple separate foam panels (i.e., multiple sections) which may be joined together by tape (such as is described below) or caulk or polyurethane foam at this stage or later in the process.

As indicated, methods of this specification comprise spray depositing the first foam-forming material into the cavity.

For example, in some implementations, the frame 11 having foam panel 70 fastened thereto may be placed on a conveyor, such as a track conveyor that is configured to convey the frame 11 and foam panel 70 fastened thereto in a substantially upright position. As used herein, the term "track conveyor" refers to a device configured to convey frame 11 of a wall structure 10 in a substantially upright position and that includes at least one, in some cases more than one, track (or line) along which the frame 11 of a wall structure can travel and upon which the wall structure 10 can rest. The tracks included in the track conveyor utilized in the methods described in this specification can comprise any of a variety of devices to facilitate conveyance of a wall structure 10 along the track(s) in a substantially upright position, such as rollers, balls, bearings, wheels, and belts, among other devices. In some embodiments, however, the tracks of the track conveyor comprise a plurality of rotating members, such as balls (sometimes referred to as ball bearing rollers) or wheels in which the track includes a plurality of such rotating members, i.e., circular objects that revolve on an axle and upon which the frame 11 lies while being conveyed, and which are disposed along the length of the track.

In some implementations, the frame 11 having foam panel 70 attached thereto may be placed on a track conveyor by tilting the frame 11 from a substantially horizontal position to a substantially upright position in which frame member rests on a substantially vertically positioned track of the conveyor. An example of such a track conveyor, which is suitable for use in the methods of this specification, is described in U.S. Pat. No. 10,227,779 at col. 10, line 24 to col. 12, line 60, the cited portion of which being incorporated herein by reference.

In these implementations, frame 11 is, in some embodiments, placed on conveyor in a substantially upright position in which rear frame surface 11*b* faces away from substantially horizontally positioned track(s) of the track conveyor, so that it is completely exposed (i.e., there is no component or device between a spray foam applicator and the rear frame surface 11*b*, which allows for easy spray foam application over the entire wall structure, as described below), whereas front frame surface 11*a* faces towards, and may be in direct contact with, substantially horizontally positioned track(s).

The track conveyor used in some implementations of the methods of this specification is configured to convey a frame 11 of a wall structure 10 in a substantially upright position. As used herein, "substantially upright position" when used with reference to the conveyance of a frame 11 of a wall structure means that the longest dimension of at least one of the frame members 12, 14, 16 and 17 is positioned generally perpendicular to the direction of gravity but not exactly perpendicular to the direction of gravity. For example, in some cases "substantially vertical" in this context means that the longest dimension of at least one of the frame members 12, 14, 16 and 17 is positioned at a slope of 75° to 88° from the direction of gravity, such as 78° to 88° from the direction of gravity, or, in some cases, 80° to 86° or 81° to 85° from the direction of gravity.

Some implementations of the methods of this specification comprise conveying the frame 11 having foam panel 70 attached thereto on the track conveyer, in a substantially upright position, to a spray foam application station where a foam-forming material is spray applied into the cavity so that the foam-forming material is self-adhered to the rear surface of foam panel 70 to thereby form a wall structure 10 having first foam layer 30 deposited in the cavity 18 in which first foam layer 30 self-adheres to foam panel 70.

Examples of foam materials that can be used to form first foam layer 30 include, but are not limited to, the materials described earlier in this specification. In some implementations, first foam layer 30 is spray applied such that it is arranged and dimensioned as described earlier in this specification.

In some implementations, first foam layer 30 may be colored by adding a pigment or dye, for example, to the foam-forming material. This may be desirable in instances where quality control assessment of the placement and dimensions of first foam layer 30 is necessary. First foam layer 30 is self-adhered to one or more frame members and is thus able to fill tight spaces and seal gaps that may not be visible to the naked eye. First foam layer 30 can also act as a vapor and thermal insulating barrier. Finally, first foam layer 30 may provide structural stability to the wall structure 10, such as improved wall racking strength, which refers to the ability of a wall structure to maintain its shape under shear stress, even when first foam layer 30 does not cover the entire rear surface of foam panel 70, thus forming only a "picture frame" of first foam layer 30 around the perimeter of cavity 18.

After allowing the first foam-forming material to cure to form first foam layer 30 in cavity 18 that is self-adhered to at least one of the first member 12, the second member 14, and a connecting member 16, 17, methods of this specification comprise spray depositing a second foam-forming material into the cavity.

As with first foam-forming material, some implementations of the methods of this specification comprise conveying the frame 11 having foam panel 70 attached thereto on the track conveyer, in a substantially upright position, to a spray foam application station where a second foam-forming material is spray applied into the cavity 18 to thereby form a wall structure 10 having: (1) first foam layer 30 deposited in cavity 18 in which first foam layer 30 is self-adhered to foam panel 70 and to at least one of the first member 12, the second member 14, and a connecting member 16, 17; and (2) second foam layer 31 deposited in the cavity in which the second foam layer 31 is self-adhered to the first foam layer 30. Second foam layer 31 may also be self-adhered to rear surface of foam panel 70. As will be appreciated, if desired, second foam-forming material may be deposited substantially immediately after deposition of first foam layer 30, while the wall structure remain in the spray foam application station or, if desired, second foam layer 31 may be deposited at a later time.

Examples of foam materials that can be used to form second foam layer 31 include, but are not limited to, the materials described earlier in this specification. In some implementations, second foam layer 31 is spray applied such that it is arranged and dimensioned as described earlier in this specification. More specifically, in some implementations, second foam layer 31 is spray applied in a manner such that it has a thickness resulting in a gap 40 being formed within the frame 11 between a rear surface of second foam layer 31 and rear frame surface 11*b*. In some embodiments, gap 40 has a width, from the rear surface of second foam layer 31 to rear frame surface 11*b*, of at least 1 inch (2.54 cm), such as 1 to 4.5 inches (2.54 to 11.43 cm), 1 to 2 inches (2.54 to 5.08 cm) or 1.5 to 2 inches (3.81 to 5.08 cm). In some embodiments, second foam layer 31 is deposited as a substantially continuous layer within the cavity 18 to provide optimal thermal insulation properties. The gap 40 can be used as an area to incorporate home utility components such as electrical wires, cords, heating and cooling pipes, and plumbing fixtures. These home utility components may be inserted into the gap 40 located between foam layers 30, 31 and rear frame surface 11*b* such that utility components are not surrounded by or contacting the foam layers 30, 31. In one example, the gap 40 comprises at least two inches as measured between second foam layer 31 and rear frame surface 11*b*.

After second foam layer 31 has expanded and cured, the substantially upright positioned wall structure 10 can be conveyed out of the spray foam application station on the track conveyer. Thereafter, if desired, foam layers 30, 31 can be deflashed to remove excess foam material, such as any foam material that is deposited on the rear frame surface 11*b*. Deflashing can, in some embodiments, be done while wall structure 10 is in a substantially upright position on the track conveyer. Various devices can be used for deflashing, such as a hoe or curry comb, among others.

In cases where the wall structure 10 comprises two or more foam panels 70 adjacent with one another. A sealant, such as a tape (or other sealant material, such as a liquid sealer) can be applied to front surfaces of the foam panels 70 and over seams formed at adjacent sides of two foam panels 70.

Various aspects of the subject matter described herein are set out in the following numbered clauses:

Clause 1. A wall structure, comprising: (a) a frame comprising: (i) a first member; (ii) a second member spaced apart from the first member; and (iii) connecting members extending between the first member and the second member, wherein the first member, the second member, and the connecting members each comprise a front surface and a rear surface that form a front frame surface and a rear frame surface; (b) a foam panel overlying the front frame surface, wherein the foam panel, the first member, the second member, and the connecting members define a cavity; (c) a first foam layer having a density of at least 2.8 lb/ft$^3$ disposed within the cavity, the first foam layer being self-adhered to the foam panel and self-adhered to at least one of the first member, the second member, and one or more connecting members, and (d) a second foam layer having a density of less than 2.8 lb/ft$^3$ that is disposed within the cavity and self-adhered to the foam panel and self-adhered to the first foam layer.

Clause 2. The wall structure of clause 1, wherein the foam panel comprises polyisocyanurate foam or polystyrene foam.

Clause 3. The wall structure of clause 1 or clause 2, wherein the foam panel comprises rigid foam.

Clause 4. The wall structure of one of clause 1 to clause 3, wherein the foam panel has a thickness of no more than 2 inches (5.08 cm), 1 to 2 inches (2.54 to 5.08 cm) or 1 to 1.5 inches (2.54 cm to 3.81 cm).

Clause 5. The wall structure of one of clause 1 to clause 4, wherein the foam panel comprises a facer on a rear face and/or a front face of a core foam layer, such as where the facer is attached to and substantially covers both sides (the front and rear faces) of a foam core layer.

Clause 6. The wall structure of clause 5, wherein the facer comprises a fiberglass mat, a glass fiber-reinforced cellulosic felt, a coated and polymer-bonded fiber mat, such as a coated glass fiber mat, a foil, such as aluminum foil, a coated foil, a foil/membrane laminate, a foil/glass composite, or a polyolefin film.

Clause 7. The wall structure of one of clause 1 to clause 6, wherein the foam panel is fastened to the front frame surface.

Clause 8. The wall structure of one of clause 1 to clause 7, wherein the first foam layer does not cover the entire rear surface of the foam panel.

Clause 9. The wall structure of one of clause 1 to clause 8, wherein the first foam layer is disposed within the cavity such that it is self-adhered to the first member, the second member, and two connecting members.

Clause 10. The wall structure of one of clause 1 to clause 9, wherein the first foam layer comprises polyurethane, polyurea, or polyisocyanurate, or a mixture thereof.

Clause 11. The wall structure of one of clause 1 to clause 10, wherein the first foam layer has a density of 3.0 to 4.0 lb/ft$^3$ (48.1 to 64.1 kg/m$^3$), 3.2 to 3.8 lb/ft$^3$ (51.3 to 60.9 kg/m$^3$) or 3.4 to 3.8 lb/ft$^3$ (54.5 to 60.9 kg/m$^3$), when measured according to ASTM D1622-08.

Clause 12. The wall structure of one of clause 1 to clause 11, wherein the first foam layer comprises a thickness extending from the rear surface of the foam panel to a position intermediate the front frame surface and the rear frame surface.

Clause 13. The wall structure of one of clause 1 to clause 12, wherein the first foam layer has a maximum depth, measured from the rear surface of the first foam layer to the rear frame surface, of no more than 3 inches (7.62 cm), such as 1.5 to 3 inches (3.81 to 7.62 cm) or 1.5 to 2.5 inches (3.81 to 6.35 cm).

Clause 14. The wall structure of one of clause 1 to clause 13, wherein the first foam layer is an in-situ formed foam layer.

Clause 15. The wall structure of one of clause 1 to clause 14, wherein the first foam layer does not cover the entire rear surface of foam panel.

Clause 16. The wall structure of clause 15, wherein the first foam layer has a maximum width, measured from an interior surface of the first member, the second member, and a connecting member to a rear surface of the first foam layer, of, for example, no more than 6 inches (15.24 cm), of 2 to 6 inches (5.08 to 15.24), or of 3 to 5 inches (7.62 to 12.7 cm).

Clause 17. The wall structure of one of clause 1 to clause 16, wherein the second foam layer is disposed within the cavity such that the second foam layer covers any portions of the rear surface of the foam panel not covered by the first foam layer.

Clause 18. The wall structure of one of clause 1 to clause 17, wherein the second foam layer comprises polyurethane, polyurea, polyisocyanurate, or a mixture thereof.

Clause 19. The wall structure of one of clause 1 to clause 18, wherein the second foam layer comprises foam made with polyurethane, polyurea, polyisocyanurate (also referred to as polyiso), or a mixture of any two or more thereof, and may comprise a foam material that is substantially free, essentially free, or completely free of halogen-containing flame retardant additives.

Clause 20. The wall structure of one of clause 1 to clause 19, wherein the second foam layer has a density of less than 2.8 lb/ft$^3$ (44.9 kg/m$^3$), of 1.5 to 2.5 lb/ft$^3$ (24.0 to 40.0 kg/m$^3$), or, in some cases, 1.7 to 2.3 lb/ft$^3$ (27.2 to 36.8 kg/m$^3$) or 1.8 to 2.2 lb/ft$^3$ (28.8 to 35.2 kg/m$^3$), when measured according to ASTM D1622-08.

Clause 21. The wall structure of one of clause 1 to clause 20, wherein the second foam layer has a density that is at least 0.5 lb/ft$^3$ (8.0 kg/m$^3$), that is 0.5 to 2.0 lb/ft$^3$ (8.0 to 32.0 kg/m$^3$), that is 0.7 to 1.3 lb/ft$^3$ (11.2 to 20.8 kg/m$^3$) or that is 0.8 to 1.2 lb/ft$^3$ (12.8 to 19.2 kg/m$^3$) less than the density of the first foam layer, each when measured according to ASTM D1622-08.

Clause 22. The wall structure of one of clause 1 to clause 21, wherein the second foam layer is an in-situ formed foam layer.

Clause 23. The wall structure of one of clause 1 to clause 22, wherein the second foam layer comprises a thickness extending from the rear surface of the foam panel to a position intermediate the front frame surface and the rear frame surface so that a gap is formed within the frame between a rear surface of the second foam layer and the rear frame surface, the gap having a width, from the rear surface of second foam layer to the rear frame surface, of at least 1 inch (2.54 cm), of 1 to 2 inches (2.54 to 5.08 cm) or of 1.5 to 2 inches (3.81 to 5.08 cm).

Clause 24. A method for manufacturing a wall structure, comprising: (a) spray depositing a first foam-forming material into a cavity defined by a frame and a foam panel overlying a front frame surface, wherein the front frame surface is formed by a front surface of a first member, a front surface of a second member that is spaced apart from the first member, and a front surface of connecting members extending between the first member and the second member; (b) allowing the first foam-forming material to cure to form a first foam layer in the cavity, the first foam layer being adhered to the foam panel and at least one of the first member, the second member, and a connecting member; (c) spray depositing a second foam-forming material into the cavity; and (d) allowing the second foam-forming material to cure to form a second foam layer in the cavity, the second foam forming layer being adhered to the first foam layer and having a density that is less than the density of the first foam layer.

Clause 25. The method of clause 24, wherein the foam panel comprises polyisocyanurate foam or polystyrene foam.

Clause 26. The method of clause 24 or clause 25, wherein the foam panel comprises rigid foam.

Clause 27. The method of one of clause 24 to clause 26, wherein the foam panel has a thickness of no more than 2 inches (5.08 cm), 1 to 2 inches (2.54 to 5.08 cm) or 1 to 1.5 inches (2.54 cm to 3.81 cm).

Clause 28. The method of one of clause 24 to clause 27, wherein the foam panel comprises a facer on a rear face and/or a front face of a core foam layer, such as where the facer is attached to and substantially covers both sides (the front and rear faces) of a foam core layer.

Clause 29. The method of clause 28, wherein the facer comprises a fiberglass mat, a glass fiber-reinforced cellulosic felt, a coated and polymer-bonded fiber mat, such as a coated glass fiber mat, a foil, such as aluminum foil, a coated foil, a foil/membrane laminate, a foil/glass composite, or a polyolefin film.

Clause 30. The method of one of clause 24 to clause 29, wherein the foam panel is fastened to the front frame surface.

Clause 31. The method of one of clause 24 to clause 30, wherein the first foam layer does not cover the entire rear surface of the foam panel.

Clause 32. The method of one of clause 24 to clause 31, wherein the first foam layer is disposed within the cavity such that it is self-adhered to the first member, the second member, and two connecting members.

Clause 33. The method of one of clause 24 to clause 32 wherein the first foam layer comprises polyurethane, polyurea, or polyisocyanurate, or a mixture thereof.

Clause 34. The method of one of clause 24 to clause 33, wherein the first foam layer has a density of 3.0 to 4.0 lb/ft$^3$ (48.1 to 64.1 kg/m$^3$), 3.2 to 3.8 lb/ft$^3$ (51.3 to 60.9 kg/m$^3$) or 3.4 to 3.8 lb/ft$^3$ (54.5 to 60.9 kg/m$^3$), when measured according to ASTM D1622-08.

Clause 35. The method of one of clause 24 to clause 34, wherein the first foam layer comprises a thickness extending from the rear surface of the foam panel to a position intermediate the front frame surface and the rear frame surface.

Clause 36. The method of one of clause 24 to clause 35, wherein the first foam layer has a maximum depth, measured from the rear surface of the first foam layer to the rear frame surface, of no more than 3 inches (7.62 cm), such as 1.5 to 3 inches (3.81 to 7.62 cm) or 1.5 to 2.5 inches (3.81 to 6.35 cm).

Clause 37. The method of one of clause 24 to clause 36, wherein the first foam layer does not cover the entire rear surface of the foam panel.

Clause 38. The method of clause 37, wherein the first foam layer has a maximum width, measured from an interior surface of the first member, the second member, and a connecting member to a rear surface of the first foam layer, of, for example, no more than 6 inches (15.24 cm), of 2 to 6 inches (5.08 to 15.24), or of 3 to 5 inches (7.62 to 12.7 cm).

Clause 39. The method of one of clause 24 to clause 38, wherein the second foam layer is disposed within the cavity such that the second foam layer covers any portions of the rear surface of the foam panel not covered by the first foam layer.

Clause 40. The method of one of clause 24 to clause 39, wherein the second foam layer comprises polyurethane, polyurea, polyisocyanurate, or a mixture thereof.

Clause 41. The method of one of clause 24 to clause 40, wherein the second foam layer comprises foam made with polyurethane, polyurea, polyisocyanurate (also referred to as polyiso), or a mixture of any two or more thereof, and may comprise a foam material that is substantially free, essentially free, or completely free of halogen-containing flame retardant additives.

Clause 42. The method of one of clause 24 to clause 41, wherein the second foam layer has a density of less than 2.8 lb/ft$^3$ (44.9 kg/m$^3$), of 1.5 to 2.5 lb/ft$^3$ (24.0 to 40.0 kg/m$^3$), or, in some cases, 1.7 to 2.3 lb/ft$^3$ (27.2 to 36.8 kg/m$^3$) or 1.8 to 2.2 lb/ft$^3$ (28.8 to 35.2 kg/m$^3$), when measured according to ASTM D1622-08.

Clause 43. The method of one of clause 24 to clause 42, wherein the second foam layer has a density that is at least 0.5 lb/ft$^3$ (8.0 kg/m$^3$), that is 0.5 to 2.0 lb/ft$^3$ (8.0 to 32.0 kg/m$^3$), that is 0.7 to 1.3 lb/ft$^3$ (11.2 to 20.8 kg/m$^3$) or that is 0.8 to 1.2 lb/ft$^3$ (12.8 to 19.2 kg/m$^3$) less than the density of the first foam layer, each when measured according to ASTM D1622-08.

Clause 44. The method of one of clause 24 to clause 43, wherein the second foam layer comprises a thickness extending from the rear surface of the foam panel to a position intermediate the front frame surface and the rear frame surface so that a gap is formed within the frame between a rear surface of the second foam layer and the rear frame surface, the gap having a width, from the rear surface of the second foam layer to the rear frame surface, of at least 1 inch (2.54 cm), of 1 to 2 inches (2.54 to 5.08 cm) or of 1.5 to 2 inches (3.81 to 5.08 cm).

The non-limiting and non-exhaustive examples that follow are intended to further describe various non-limiting and non-exhaustive embodiments without restricting the scope of the embodiments described in this specification.

EXAMPLES

Figure 4A:
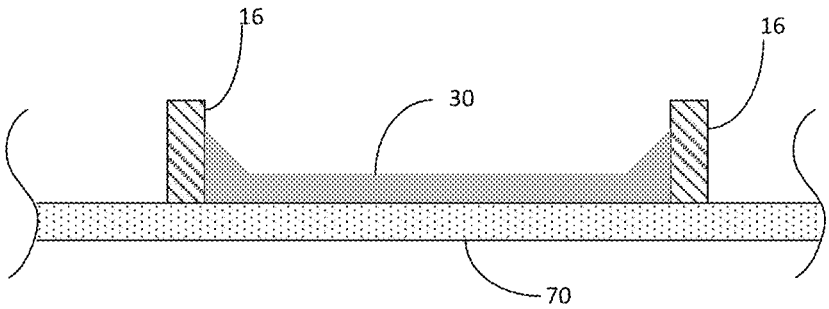
FIGS. 4*a*-4*d* are top cross-sectional views of wall structures with targeted spray foam depths used in the Examples.
Figure 4B:
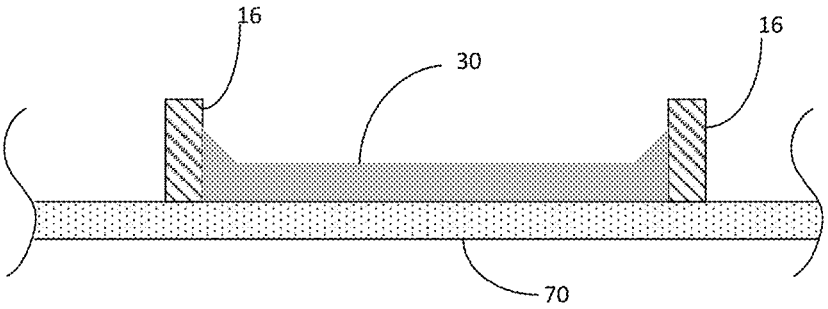
Figure 4C:
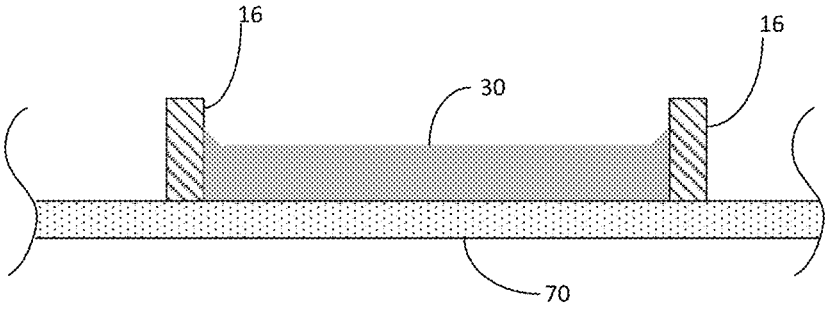
Figure 4D:
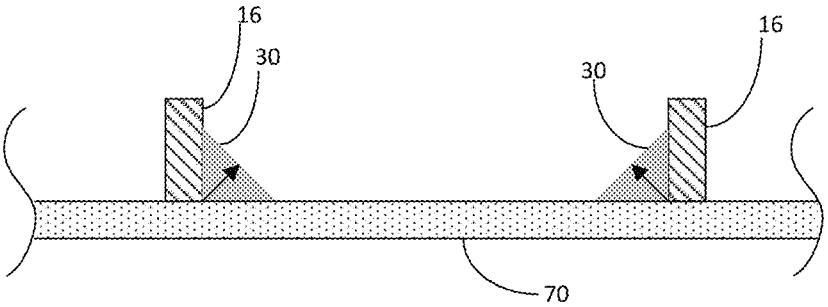

Twelve 8'×8' wall panels were assembled, with studs 24" on-center, and 1" Hunter PW-CG polyiso board attached to the front frame surface as continuous insulation. The polyiso board was fastened to the stud frame with button-cap nails at a frequency of 12" on the perimeter, and 24" in the field. Triplicate wall panels were prepared at each of three target spray foam depths (1.0", 1.5", and 2.0"), as illustrated in FIGS. 4*a*-4*c*, using Hunter PW-STR spray foam with a typical applied density of 3.2 to 3.8 lb/ft$^3$. The final three wall panels were sprayed around the perimeter of the cavity using a picture frame technique, as illustrated in FIG. 4*d*. In this case, an average spray foam depth was not applicable; however, the spray foam operator attempted to spray to a depth of 1.5" as measured diagonally into the inside edge of the cavity, as shown by the arrows in FIG. 4*d*.

Figure 5:
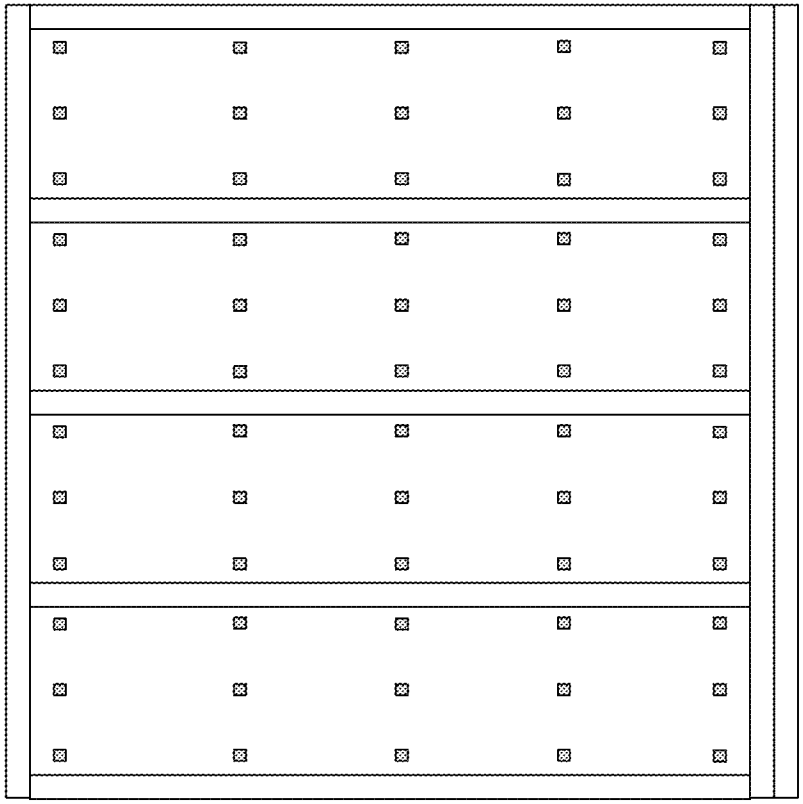
FIG. 5 depicts the location of spray foam thickness measurements taken in the Examples.

After the spray foam was applied, thickness measurements were taken in 60 different locations for each wall panel, as illustrated in FIG. 5. The wall panels were tested according to ASTM E72-15 racking frame using a modified loading protocol in which, instead of intermittent piston pushes, the walls were tested to failure at a constant piston speed of 16 mm/min.

Results (spray foam thickness and wall racking strength) are shown in Table 1.

TABLE 1

| Example | Spray Foam Avg Thickness (inches) | Maximum Racking Shear (lbs/ft) | Average Racking Shear (lbs/ft) |
|---|---|---|---|
| 1a | 0.93 | 690 | 722 |
| 1b | 0.98 | 798 | |
| 1c | 1.01 | 679 | |
| 2a | 1.42 | 681 | 720 |
| 2b | 1.48 | 709 | |
| 2c | 1.48 | 769 | |
| 3a | 1.99 | 913 | 851 |
| 3b | 1.99 | 903 | |
| 3c | 1.99 | 736 | |
| 4a | n/a (picture frame) | 500 | 573 |
| 4b | n/a (picture frame) | 628 | |
| 4c | n/a (picture frame) | 591 | |

As is apparent, Example 4 provided about 80% of the shear strength of Examples 1-2. It is believed that this finding could enable the use of a wall structure design in which a higher density (around 3 lb/ft$^3$ or more) structural foam is disposed around the perimeter of a cavity, while a lower density traditional close celled foam (about 2 lb/ft$^3$) is disposed elsewhere in the cavity to provide a foam wall structure of sufficient shear strength.

Various features and characteristics of the inventions are described in this specification to provide an overall understanding of the disclosed wall structures and method of manufacture. It is understood that the various features and characteristics described in this specification can be combined in any suitable manner regardless of whether such features and characteristics are expressly described in combination in this specification. The Applicant expressly intends such combinations of features and characteristics to be included within the scope of this specification. As such, the claims can be amended to recite, in any combination, any features and characteristics expressly or inherently described in, or otherwise expressly or inherently supported by, this specification. Furthermore, the Applicant reserves the right to amend the claims to affirmatively disclaim features and characteristics that may be present in the prior art, even if those features and characteristics are not expressly described in this specification. Therefore, any such amendments will not add new matter to the specification or claims, and will comply with written description and sufficiency of description requirements (e.g., 35 U.S.C. § 112(a) and Article 123(2) EPC). The wall structures and methods disclosed in this specification can comprise, consist of, or consist essentially of the various features and characteristics described in this specification.

Also, any numerical range recited in this specification describes all sub-ranges of the same numerical precision (i.e., having the same number of specified digits) subsumed within the recited range. For example, a recited range of "1.0 to 10.0" describes all sub-ranges between (and including) the recited minimum value of 1.0 and the recited maximum value of 10.0, such as, for example, "2.4 to 7.6," even if the range of "2.4 to 7.6" is not expressly recited in the text of the specification. Accordingly, the Applicant reserves the right to amend this specification, including the claims, to expressly recite any sub-range of the same numerical precision subsumed within the ranges expressly recited in this specification. All such ranges are inherently described in this specification such that amending to expressly recite any such sub-ranges will not add new matter to the specification or claims, and will comply with written description and sufficiency of description requirements (e.g., 35 U.S.C. §§ 112(a) and Article 123(2) EPC). Additionally, numerical parameters described in this specification should be construed in light of the number of reported significant digits, the numerical precision of the number, and by applying ordinary rounding techniques. It is also understood that numerical parameters described in this specification will necessarily possess the inherent variability characteristic of the underlying measurement techniques used to determine the numerical value of the parameter.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and can be employed or used in an implementation of the described processes, compositions, and products. Further, the use of a singular noun includes the plural, and the use of a plural noun includes the singular, unless the context of the usage requires otherwise.

What is claimed is:

1. A foam wall structure, comprising:

(a) a frame comprising:

(i) a first member;

(ii) a second member spaced apart from the first member; and (iii) connecting members extending between the first member and the second member, wherein the first member, the second member, and the connecting members each comprise a front surface and a rear surface that form a front frame surface and a rear frame surface;

(b) a foam panel overlying the front frame surface, wherein the foam panel, the first member, the second member, and the connecting members define a cavity;

(c) a first spray-applied polyurethane foam layer having a density of at least 2.8 lb/ft$^3$ disposed within the cavity, the first foam layer being self-adhered to the foam panel and self-adhered to each of the first member, the second member, and two connecting members, wherein the first spray-applied polyurethane foam layer:

(i) has a width, in the dimension measured from a surface of the first member, the second member and the connecting members facing the cavity, such that the first spray-applied polyurethane foam layer does not cover the entire portion of the rear surface of the foam panel facing the cavity, and (ii) has a thickness, in the dimension extending from the rear surface of the foam panel, such that the first spray-applied polyurethane foam layer extends to a position intermediate the front frame surface and the rear frame surface, such that a gap is formed between a rear surface of first spray-applied polyurethane foam layer and the rear frame surface; and (d) a second spray-applied polyurethane foam layer having a density of less than 2.8 lb/ft$^3$ that is disposed within the cavity and self-adhered to the foam panel and self-adhered to the first foam layer, wherein the second spray-applied polyurethane foam layer:

(i) has a width such that the second spray-applied polyurethane foam layer covers the portion of the rear surface of the foam panel facing the cavity that is not covered by the first spray-applied polyurethane foam layer and covers at least a portion of the rear surface of the first spray-applied polyurethane foam layer; and (ii) has a thickness, in the dimension extending from the rear surface of the foam panel, such that the second spray-applied polyurethane foam layer extends to a position intermediate the front frame surface and the rear frame surface, such that a gap is formed between a rear surface of second spray-applied polyurethane foam layer and the rear frame surface.

2. The wall structure of claim 1, wherein the foam panel comprises polyisocyanurate foam.

3. The wall structure of claim 2, wherein the foam panel comprises a facer on a rear face and a front face of a core polyisocyanurate foam layer.

4. The wall structure of claim 1, wherein the foam panel is fastened to the front frame surface.

5. The wall structure of claim 1, wherein the first spray-applied polyurethane foam layer has a density of 3.0 to 4.0 lb/ft$^3$ (48.1 to 64.1 kg/m$^3$).

6. The wall structure of claim 1, wherein the second spray-applied polyurethane foam layer is disposed within the cavity such that the second spray-applied polyurethane foam layer is only self-adhered to the foam panel at portions of the rear surface of foam panel that are not covered by the first spray-applied polyurethane foam layer.

7. The wall structure of claim 1, wherein the second spray-applied polyurethane foam layer has a density of 1.8 to 2.2 lb/ft$^3$ (28.8 to 35.2 kg/m$^3$).

8. The wall structure of claim 1, wherein the second spray-applied polyurethane foam layer has a density that is at least 0.5 lb/ft$^3$ (8.0 kg/m$^3$) less than the density of the first spray-applied polyurethane foam layer.

9. A method for manufacturing a wall structure, comprising:

(a) spray depositing a first polyurethane foam-forming material into a cavity defined by a frame and a foam panel overlying a front frame surface, wherein the front frame surface is formed by a front surface of a first member, a front surface of a second member that is spaced apart from the first member, and a front surface of connecting members extending between the first member and the second member;

(b) allowing the first polyurethane foam-forming material to cure to form a first polyurethane foam layer in the cavity, the first polyurethane foam layer being self-adhered to the foam panel and self-adhered to the first member, the second member, and two connecting members, and wherein the first polyurethane foam layer:

(i) has a width, in the dimension measured from a surface of the first member, the second member and the connecting members facing the cavity, such that the first polyurethane foam layer does not cover the entire portion of the rear surface of the foam panel facing the cavity, and (ii) has a thickness, in the dimension extending from the rear surface of the foam panel, such that the first polyurethane foam layer extends to a position intermediate the front frame surface and the rear frame surface, such that a gap is formed between a rear surface of first polyurethane foam layer and the rear frame surface;

(c) spray depositing a second polyurethane foam-forming material into the cavity; and (d) allowing the second polyurethane foam-forming material to cure to form a second polyurethane foam layer in the cavity, the second foam layer being self-adhered to the first polyurethane foam layer, self-adhered to the foam panel overlying the front frame surface, and having a density that is less than the density of the first polyurethane foam layer, and wherein the second polyurethane foam layer:

(i) has a width such that the second polyurethane foam layer covers the portion of the rear surface of the foam panel facing the cavity not covered by the first polyurethane foam layer and covers at least a portion of the rear surface of the first polyurethane foam layer; and (ii) has a thickness, in the dimension extending from the rear surface of the foam panel, such that the second polyurethane foam layer extends to a position intermediate the front frame surface and the rear frame surface, such that a gap is formed between a rear surface of second polyurethane foam layer and the rear frame surface.

10. The method of claim 9, wherein the first polyurethane foam layer has a density of 3.0 to 4.0 lb/ft$^3$ (48.1 to 64.1 kg/m$^3$).

11. The method of claim 10, wherein the second polyurethane foam layer has a density of 1.8 to 2.2 lb/ft$^3$ (28.8 to 35.2 kg/m$^3$).

12. The method of claim 9, wherein the second polyurethane foam layer has a density that is at least 0.5 lb/ft$^3$ (8.0 kg/m$^3$) less than the density of the first polyurethane foam layer and the second polyurethane foam layer is spray deposited into the cavity such that the second polyurethane foam layer is only self-adhered to the foam panel at portions of the rear surface of foam panel that are not covered by the first polyurethane foam layer.

13. The method of claim 9, wherein the foam panel comprises a facer on a rear face and a front face of a core polyisocyanurate foam layer.

* * * * *